US007997915B2

(12) United States Patent
Pueschner et al.

(10) Patent No.: US 7,997,915 B2
(45) Date of Patent: Aug. 16, 2011

(54) PIN OR SOCKET CONTACT WITH RESILIENT CLIP

(75) Inventors: Klaus Pueschner, Detmold (DE); Torsten Wuensche, Leopoldshoehe (DE); Klaus Holterhoff, Olpe (DE); Klaus Wohlgemuth, Kalletal (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 12/757,703

(22) Filed: Apr. 9, 2010

(65) Prior Publication Data

US 2010/0267292 A1 Oct. 21, 2010

(30) Foreign Application Priority Data

Apr. 18, 2009 (DE) ..... 20 2009 005 809 U

(51) Int. Cl.
*H01R 11/22* (2006.01)

(52) U.S. Cl. ..... 439/268; 439/439

(58) Field of Classification Search ..... 439/268, 439/439, 835, 441
See application file for complete search history.

(56) References Cited

U.S. PATENT DOCUMENTS

| | | | | |
|---|---|---|---|---|
| 2,122,252 | A | 6/1938 | Hayes | |
| 4,381,130 | A * | 4/1983 | Sprenkle | 439/268 |
| 4,618,199 | A * | 10/1986 | Pfaff | 439/266 |
| 4,655,526 | A * | 4/1987 | Shaffer | 439/268 |
| 4,752,250 | A * | 6/1988 | Seidler | 439/751 |
| 4,836,798 | A * | 6/1989 | Carter | 439/268 |
| 6,012,944 | A | 1/2000 | Hatakeyama | |
| 6,361,364 | B1 | 3/2002 | Holland et al. | |
| 6,655,974 | B2 * | 12/2003 | Nakano et al. | 439/259 |
| 7,165,986 | B2 * | 1/2007 | Hayakawa | 439/268 |
| 7,611,373 | B1 * | 11/2009 | LaSalvia | 439/394 |
| 7,635,277 | B2 * | 12/2009 | Kanesashi | 439/331 |

FOREIGN PATENT DOCUMENTS

| | | | |
|---|---|---|---|
| DE | 310985 | A | 9/1917 |
| DE | 2717402 | A1 | 10/1978 |
| DE | 2918437 | A1 | 11/1980 |
| DE | 8137617 | U1 | 5/1982 |
| DE | 102004001202 | A1 | 7/2004 |
| DE | 102005053566 | A1 | 5/2007 |
| DE | 102006014646 | A1 | 10/2007 |

* cited by examiner

*Primary Examiner* — Gary F. Paumen
(74) *Attorney, Agent, or Firm* — Lawrence E. Laubscher, Sr.; Lawrence E. Laubscher, Jr.

(57) ABSTRACT

An electrical pin or socket terminal includes a vertical tubular body portion, and a spring clip portion connected with the upper end of the body portion. The spring clip portion includes two opposed electrical contacts at least one of which is resiliently biased toward the other. A separating arrangement is operable between a separated condition retaining the contacts in separated spaced relation for longitudinally receiving therebetween a conductor bare end, and a released condition in which the contacts are released for resilient electrical engagement with diametrically opposed surfaces of the conductor bare end. In one embodiment, the spring clip portion includes a pair of parallel spaced struts the upper ends of which are reversely bent toward each other. In another embodiment, a leaf spring electrical contact biases the bare conductor end against a stationary electrical contact.

8 Claims, 4 Drawing Sheets

G
1'
3
25
15
9
10
16
18
17
13
6
2
7
23
24
1
6a
1a

PIN OR SOCKET CONTACT WITH RESILIENT CLIP

BACKGROUND OF THE INVENTION

1. Field of the Invention

An electrical pin or socket terminal includes a vertical tubular body portion, and a spring clip portion connected with the upper end of the body portion. The spring clip portion includes two opposed electrical contacts at least one of which is resiliently biased toward the other. A separating arrangement is operable between a separated condition retaining the contacts in separated spaced relation for longitudinally receiving therebetween a conductor bare end, and a released condition in which the contacts are released for resilient electrical engagement with the conductor bare end.

2. Description of Related Art

Electrical terminals of the male jack or female socket type are known in the art which are provided at one end with spring clip means for connection with the bare end of an insulated conductor, as evidenced, for example, by the German patents Nos. DE 2717402 and DE 102005053566 A1. In the case of German patent No. DE 2717402, disconnection is relatively difficult due to the plurality of shock-absorbing struts. In the case of the terminal plug known from German patent No. DE 102005053566 A1, it is under certain circumstances also difficult to open the contact point in confined spaces.

The present invention was developed to solve these problems, in other words, to provide for simplified connection and disconnection of the components.

SUMMARY OF THE INVENTION

Accordingly, a primary object of the present invention is to provide an electrical pin or socket terminal or connector component including a vertical tubular body portion, and a spring clip portion connected with the upper end of the body portion, said spring clip portion having two opposed electrical contacts at least one of which is resiliently biased toward the other. A separating arrangement is operable between a separated condition retaining the contacts in separated spaced relation for longitudinally receiving therebetween a conductor bare end, and a released condition in which the contacts are released for resilient electrical engagement with the conductor bare end.

In one embodiment, the spring clip portion is bifurcated to define a pair of parallel spaced resilient struts the upper ends of which are reversely bent toward each other. A synthetic plastic operating member is provided having a pair of tab portions that are manually squeezed together on opposite sides of the struts, thereby to pivot the reversely-bent end portions apart about an intermediate stop portion to the separated condition. The stop portion also serves to limit the extent to which the bare conductor end is longitudinally inserted into the spring clip end of the connector. An annular guide collar may be provided for longitudinally guiding the conductor relative to the connector. Limiting means on the operating member serve to limit the extent of separation of the struts.

In another embodiment, an inverted V-shaped leaf contact spring electrical contact biases the bare conductor end against a stationary electrical contact. The leaf spring is maintained in the separated condition by a horizontal separating spring having a leg portion containing a notch that receives the free extremity of the contact spring to retain the same in the separated condition. When the bare end of the conductor is inserted longitudinally into the connector, the separating spring is deformed to release the contact spring from its separated condition. Alternatively, the leaf contact spring is maintained in the separated condition by a longitudinally displaceable synthetic plastic retaining member.

As a consequence of the invention, a user may easily connect and disconnect a conductor from a jack or socket connector.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figures 1A, 1B:
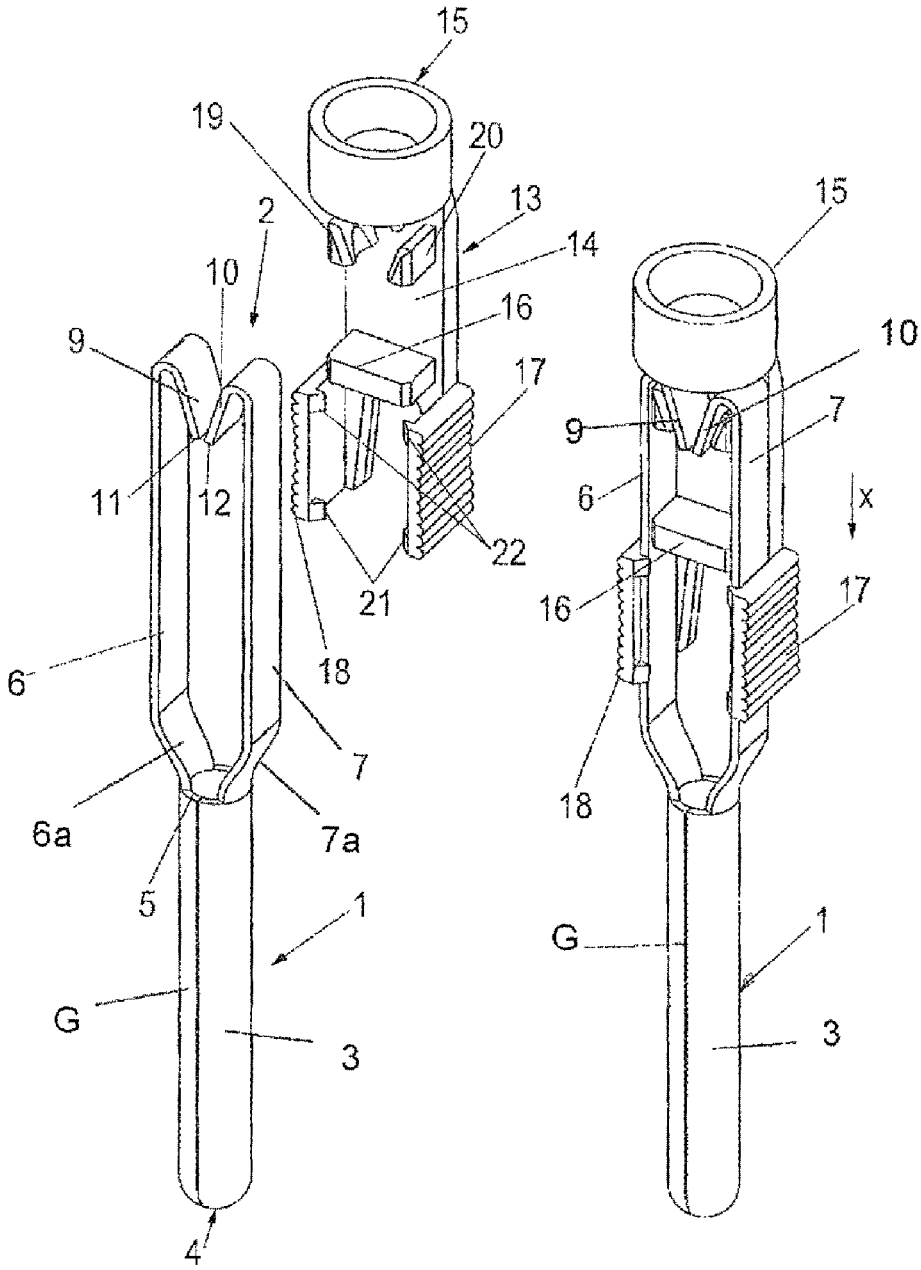
FIGS. 1*a* and 1*b* are exploded and assembled perspective views, respectively, of a first embodiment of the electrical component of the present invention.

Referring first more particularly to FIGS. 1*a* and 1*b*, the electrical jack terminal or connector 1 includes a vertical tubular body portion 3 connected at its upper end 5 with a bifurcated spring clip portion 2 including a pair of parallel spaced resilient strut 6 and 7 portions that terminate at their upper ends in reversely-bent inwardly-directed angular contact portions 9 and 10 having opposed terminal edges 11 and 12, respectively. The struts are resiliently biased together to effect engagement between the contact edges 11 and 12. The lower end 4 of the tubular body portion is closed, thereby to define the male jack contact.

A synthetic plastic separating member 13 is provided having a vertical planar base portion 14 that carries intermediate its upper and lower ends an orthogonally arranged horizontal stop portion 16. The lower end of the base portion is bifurcated to define a pair of leg portions that support a pair of vertical parallel spaced resilient finger tab portions 17 and 18. At its upper end, the base portion 14 carries an annular horizontally-arranged guide collar 15, and a pair of limiting projections 19 and 20.

When the contact separating member 13 is laterally displaced from the disassembled position of FIG. 1*a* toward the assembled condition of FIG. 1*b*, the stop portion 16 is inserted between the struts 6 and 7, and the finger tab portions are arranged externally of the struts 7 and 6, respectively. The annular guide ring portion is seated on the upper ends of the struts, and the limiting projections 19 and 20 extend between the inwardly reversely bent end portions 11 and 12, respectively.

Figures 2A, 2B, 2C, 2D, 2E, 2F:
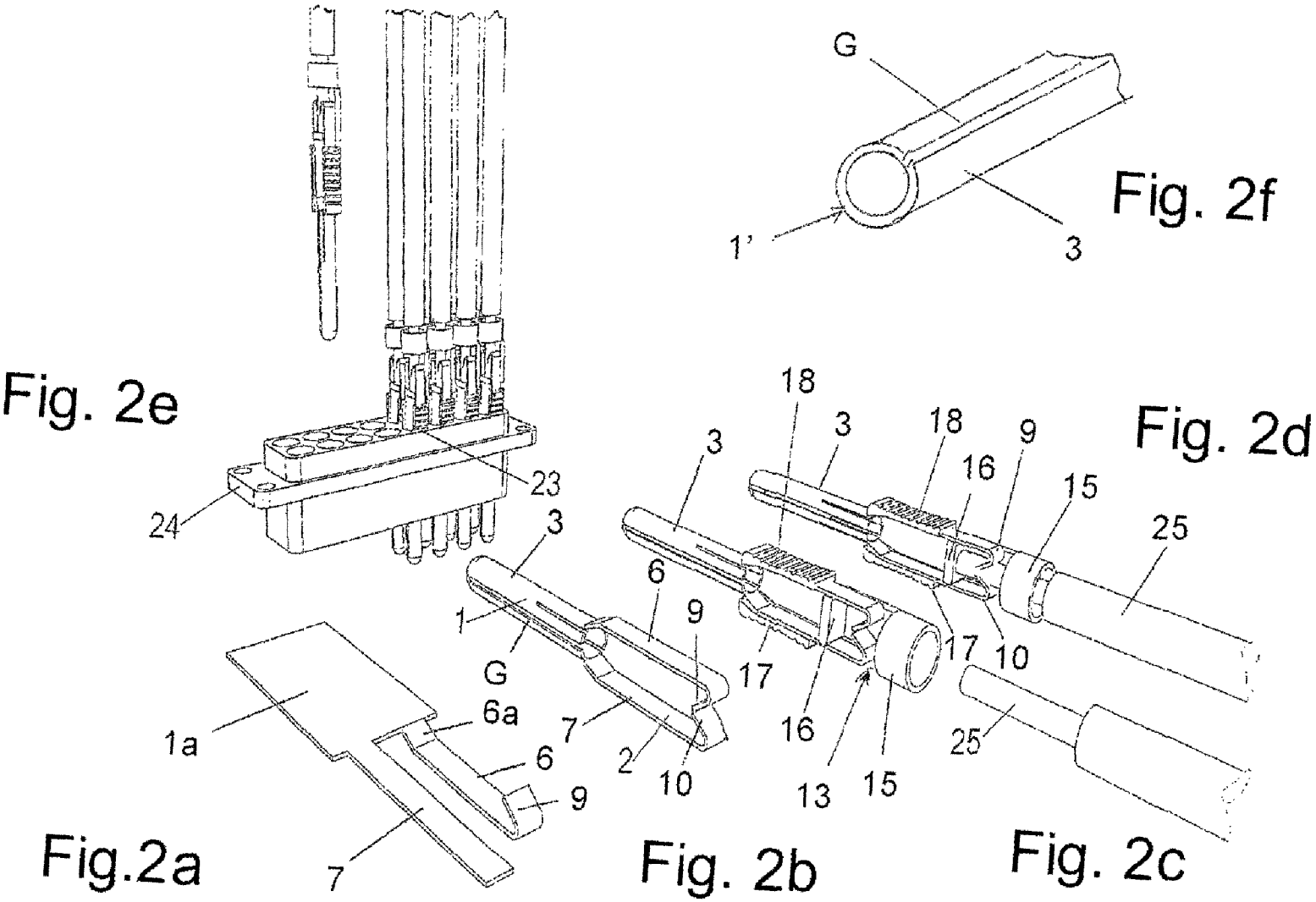
FIGS. 2*a*-2*d* illustrate the forming and assembling steps for producing the electrical pin component of FIG. 1*b*.
FIG. 2*e* is a perspective view of a multi-conductor connector arrangement including a plurality of the pin contacts of FIG. 2*d*.
FIG. 2*f* is a perspective view of a socket modification of the apparatus of FIG. 1*b;*

Referring to FIGS. 2*a* and 2*b*, the terminal or connector is formed by stamping, rolling and bending a flat blank 1*a* of a resilient conductive metal, such as copper, a brass alloy, or the like. The struts are bent to define the outwardly flared bridging portions 6*a* and 7*a*, and the blank is rolled about its longitudinal axis to define the tubular body portion 3, the edges being slightly spaced to define a small gap G. The lower end of the blank is bent to a closed condition, thereby to define the end of the jack contact terminal. The strut portions 6 and 7 are in parallel spaced relation, and the reversely inwardly bent end portions 9 and 10 are in opposed relation.

The separating member 13 is then mounted in place (FIG. 2*c*). When the finger tab portions 17 and 18 are squeezed together, the upper ends of the struts are pivoted a part to separate the bent end portions 9 and 10, thereby to permit the insertion of the bare end of the conductor 25. As shown in FIG. 2*d*, the conductor is then longitudinally inserted into the terminal (in the direction x in FIG. 1*b*) until the bare conductor end engages the stop portion 16 on the contact separating member 13. The limiting projections 19 and 20 limit the extent of outward displacement of the bent end portions 9 and 10. Upon release of the pressure on finger portions 17 and 18, the struts 6 and 7 are resiliently biased together to cause the edges 11 and 12 to engage and dig into the bare conductor end, thereby to resist withdrawal of the conductor from the connector.

To remove the conductor from the connector, the user merely squeezes together the finger tab portions 17 and 18 to separate the contacts 9 and 10 from the conductor 25, and then displaces the conductor longitudinally away from the connector.

Referring to FIG. 2*e*, it wall be seen that a number of the connectors may be mounted together by a housing 23 to define a multi-contact plug connector, which housing is provided with mounting ears 24 As shown in FIG. 2*f*, if the free end of the rolled body portion 3' is left open, the connector comprises a socket terminal component.

The separating member 13 performs at least one or more of the following advantageous functions:

(a) a conductor insertion aid, (b) a conductor insertion limiting function, (c) a spring clip contact opener.

Preferably, the opening movement is limited by bridges 19, 20, which engage into the corner area between ends 9, 10 and strut segment 6 and 7. Upon finger tabs 17 and 18, which have serrated outer surfaces, one can furthermore arrange catch edges 21, 22 for the purpose of catching upon the shock-absorbing struts 6, 7, thereby to lock the functional element 13 upon the metal part. Separating element 13 preferably consists of an insulating synthetic plastic material. It is functionally also conceivable to make it as a metal part, for example, in that bridge 16 is molded upon one of the shock-absorbing struts and that one dispenses with the plastic handle segments. In this case, the pressure is exerted directly upon the shock-absorbing struts 6, 7. The illustrated terminal contact is cheap, compact and reliable. It is sufficiently suitable for use in a rack 23 for the on-site preparation of a patch plug 24 supporting several terminal contacts (FIG. 2*f*).

Figure 3A:
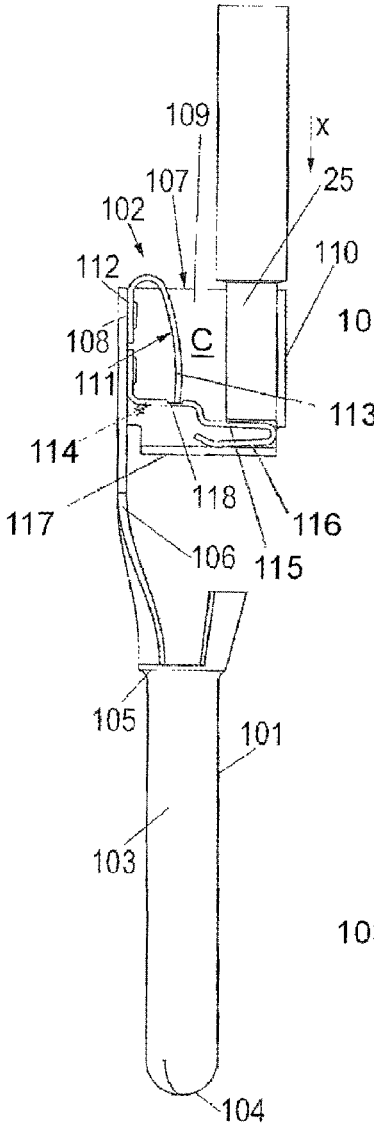
FIG. 3*a* is a side elevation view of a second embodiment of the invention when in the separated condition.
Figure 3B:
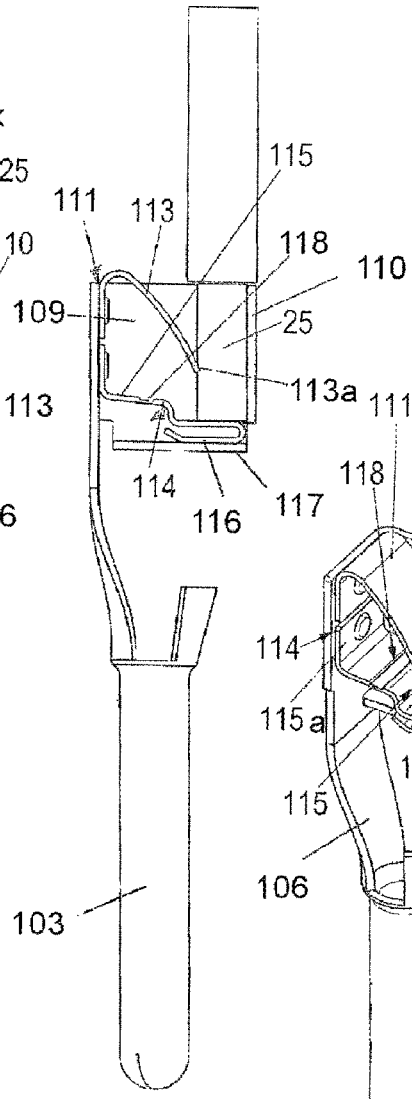
FIGS. 3*b* and 3*c* are side elevation and perspective views, respectively of the apparatus of FIG. 3*a* when in the released condition.
Figure 3C:
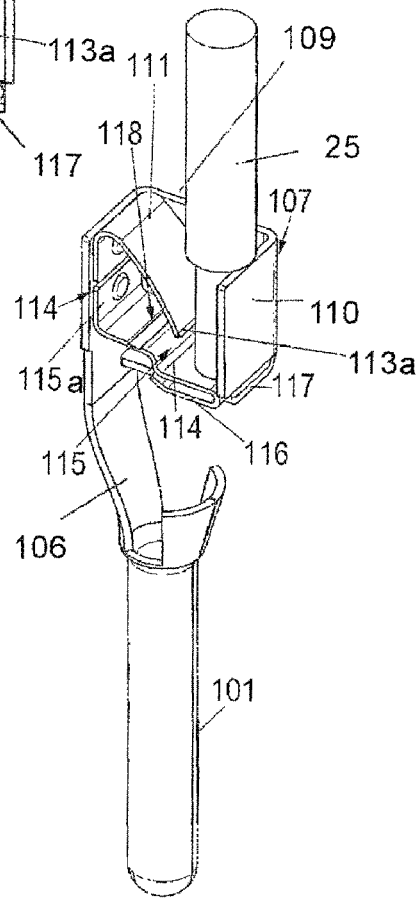

In a second embodiment of the invention illustrated in FIGS. 3*a*-3*c*, the jack terminal 101 includes a vertical lower tubular body portion 103, and an upper spring clip portion 102 connect by an bridging portion 106 with the upper end of the tubular body portion. In this case, the contact spring 111 is an inverted generally V-shaped leaf spring having a first leg portion 112 secured to the planar first vertical side wall 108 of a conductive clamping cage 107 that is integral with the bridging portion 106. The clamping cage includes a second vertical side wall 109 normal to the first side wall 108, a third vertical side wall 110 parallel with the first side wall, and a horizontal bottom wall 116. The cage side and bottom walls cooperate to define a chamber C in which the contact spring 111 is mounted. The second leg 113 of the contact spring is resiliently biased toward the conductive third side wall 110, which defines a stationary electrical contact.

Also connected with the first cage wall 108 is a separating leaf spring 114 having a horizontal upper first leg 115, and a horizontal lower leg 117 that is supported by the bottom cage wall 116. The upper surface of the upper leg 115 contains a retaining notch 118 that receives the free extremity of the leg 113 of the contact spring when the contact spring is in the separated condition of FIG. 3*a*. Consequently, when the conductor bare end 25 is inserted longitudinally downwardly into the cage chamber C (as indicated by the arrow x), the upper leg 114 of the separating spring is deformed downwardly to release the contact second leg 113, thereby to displace the conductor bare end laterally toward electrical engagement with the stationary cage contact 110, as shown in FIGS. 3*b* and 3*c*. The free extremity edge 113*a* of the contact spring leg 113 digs into the circumferential surface to the conductor bare end, thereby to lock the conductor and the jack terminal together. To release the conductor, the user merely inserts the tip of a screwdriver or the like into the chamber C to deflect the contact spring leg away from, and out of engagement with, the conductor 25.

Figure 4A:
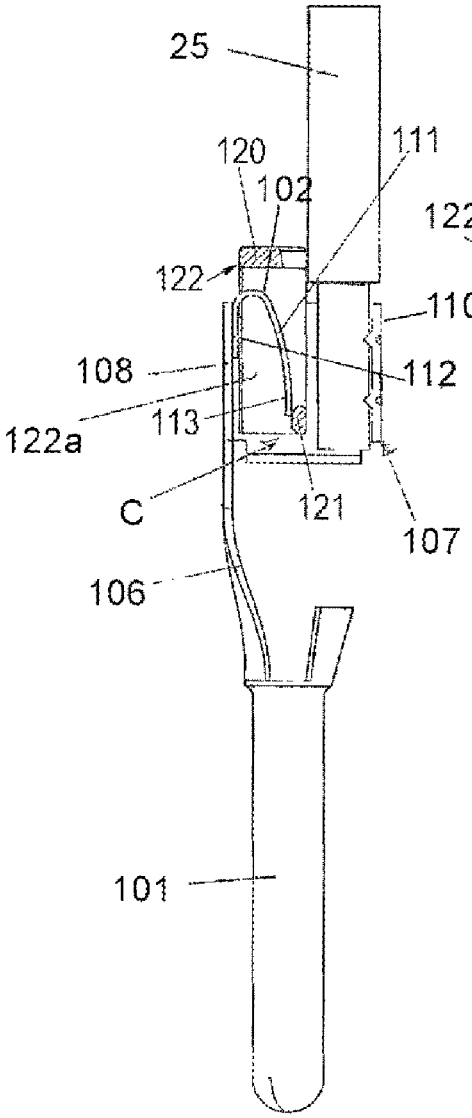
FIG. 4*a* is a side elevation view of a third embodiment of the invention when in the separated condition.
Figure 4B:
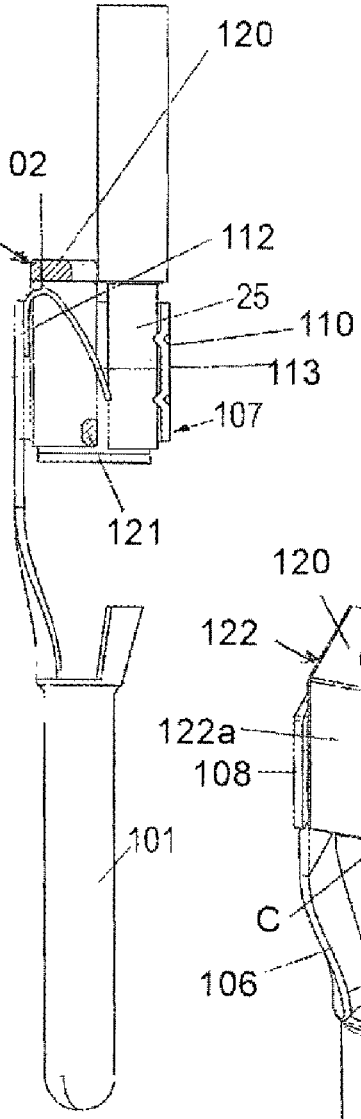
FIGS. 4*b* and 4*c* are side elevation and perspective views, respectively, of the apparatus of FIG. 4*a* when in the released condition.
Figure 4C:
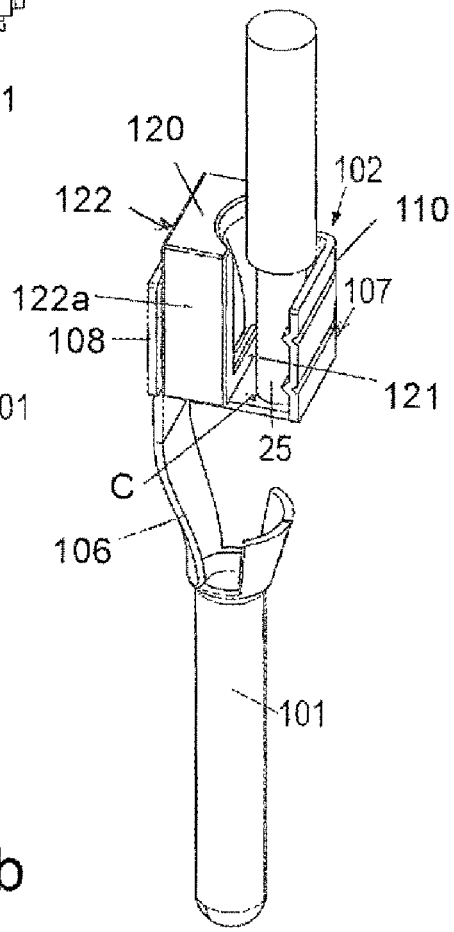

In the modification shown in FIGS. 4*a*-4*c*, the contact spring leg 113 is retained in the separated condition by a separating member 122 that is formed from synthetic plastic material and is mounted for vertical displacement in the cage chamber C. The separating member 122 is hollow and includes a pair of vertical parallel spaced side walls normal to the cage first side wall 108, a horizontal top wall 120, and a horizontal retaining bar 121 extending between the side walls 122*a*. The separating member 122 is mounted about the contact spring 111 for vertical displacement in the cage chamber C between the upper separating position of FIG. 4*a*, and the lower released position of FIGS. 4*b* and 4*c*.

When the separating member 122 is in the upper separating position of FIG. 4*a*, the horizontal bar portion 121 retains the contact spring leg 111 in the separated condition. When the separating member 122 is manually displaced downwardly by the application of force to the upper surface of the top wall 120, the separating bar 121 is displaced downwardly to release the contact spring leg 111, whereupon the contact spring leg 111 biases the conductor bare end toward electrical engagement with the stationary contact wall 110.

Similar to the model according to FIG. 1, terminal contact 101 is shaped from sheet metal to form a cylindrical pipe segment 103 whose circumference is not closed. This pipe segment 103 furthermore again is bent into a round shape at a free end 104 in order to simplify the insertion into a corresponding jack contact. In this way, push-in connection can in a simple way be retained in an open separated condition, which simplifies its handling. It is also conceivable to make springs 111 and 114 integral for which purpose one merely needs to bridge the gap 119 between the ends that are fixed upon the clamping cage by using a material bridge.

This terminal also has a simple construction and is nevertheless functionally reliable.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector component adapted for connection with the bare end of an insulated conductor (21), comprising:

(a) an electrical connector (1) having a vertical tubular body portion (3), and a spring clip portion (2) connected with the upper end of said body portion, (1) said connector body portion being formed by circularly bending a flat rectangular conductive metal blank (1*a*) about a longitudinal axis to define a cylinder, the longitudinal edges of said bent blank being spaced to define a longitudinal gap (G);

(2) said spring clip portion including a pair of opposed electrical contacts resiliently biased toward the other, said resilient contacts including a pair of vertical parallel spaced resilient strut portions (6, 7) having lower end portions (6*a*, 7*a*) that are integrally connected with said body portion, said strut portions terminating at their upper ends in angularly inwardly and downwardly bent opposed end portions (9, 10); and (b) separating means (13) operable between a separated condition retaining said contacts in separated spaced relation for the longitudinal introduction therebetween of the conductor bare end, and a released condition in which said contacts are released for resilient electrical engagement with the conductor bare end.

2. An electrical connector component as defined in claim 1, wherein the free extremities of said bent end portions terminate in edge portions (11, 12) that are adapted for locking engagement with diametrically opposed circumferential portions of said bare conductor end when said contacts are in said released condition.

3. An electrical connector component as defined in claim 1, wherein said separating means comprises a contact separating member (13) formed of synthetic plastic material and including:

(1) a vertical planar base portion (14);

(2) a horizontal stop portion (16) extending orthogonally from said base portion; and (3) means for mounting said separating member on said connector spring clip portion with said connecting member stop portion extending between said strut portions, said mounting means including a pair of parallel spaced vertical resilient tab portions (17, 18) extending orthogonally from said base portion on remote sides of said spring clip strut portions, said tab portions being arranged at a lower elevation than said stop portion, whereby upon manually pressing together said tab portions, said strut portions are pivoted about said stop portion to displace said contacts outwardly toward said separated condition.

4. An electrical connector component as defined in claim 3, and further including locking catches (21, 22) arranged on said tab portions for retaining said separating member on said connector clip portion.

5. An electrical connector component as defined in claim 3, and further including limiting means (19, 20) arranged on said separating member base portion for limiting the extent of separation of said contacts.

6. An electrical connector component as defined in claim 3, and further including a horizontal annular guide collar (15) arranged at the upper end of said separating member base portion for vertically guiding the conductor toward a seated position in which said bare end portion is in engagement with the upper surface of said separating member horizontal stop portion.

7. An electrical connector component as defined in claim 1, wherein the other end of said body portion (4) is closed, whereby said connector component comprises a pin terminal.

8. An electrical connector component as defined in claim 1, wherein the other end of said body portion is open, whereby said connector component comprises a socket terminal.

* * * * *